US006085545A

United States Patent [19]

Johnston

[11] Patent Number: 6,085,545

[45] Date of Patent: Jul. 11, 2000

[54] LIQUID NATURAL GAS SYSTEM WITH AN INTEGRATED ENGINE, COMPRESSOR AND EXPANDER ASSEMBLY

[76] Inventor: Richard P. Johnston, 641 Joe Wheeler Brown Rd., Fulton, Miss. 38843

[21] Appl. No.: 09/157,025

[22] Filed: Sep. 18, 1998

[51] Int. Cl.[7] ..... F25J 1/00

[52] U.S. Cl. ..... 62/613; 62/619

[58] Field of Search ..... 62/611, 613, 619

[56] References Cited

U.S. PATENT DOCUMENTS

| | | | |
|---|---|---|---|
| 3,657,898 | 4/1972 | Ness et al. . | |
| 3,735,600 | 5/1973 | Dowdoll et al. . | |
| 3,818,714 | 6/1974 | Etzbach et al. . | |
| 3,837,172 | 9/1974 | Markbreiter et al. . | |
| 4,033,735 | 7/1977 | Swenson . | |
| 4,139,019 | 2/1979 | Bresie et al. . | |
| 4,213,476 | 7/1980 | Bresie et al. . | |
| 4,215,753 | 8/1980 | Champness . | |
| 4,359,871 | 11/1982 | Strass . | |
| 4,419,114 | 12/1983 | May et al. . | |
| 4,505,722 | 3/1985 | Shelton, Jr. . | |
| 4,566,886 | 1/1986 | Fabian et al. | 62/619 |
| 4,920,749 | 5/1990 | Letarte . | |
| 4,948,404 | 8/1990 | Delong | 62/619 |
| 4,970,867 | 11/1990 | Herron et al. . | |
| 5,003,782 | 4/1991 | Kucerija . | |
| 5,036,671 | 8/1991 | Nelson et al. . | |
| 5,199,266 | 4/1993 | Johansen . | |
| 5,231,835 | 8/1993 | Beddome et al. . | |
| 5,287,703 | 2/1994 | Bernhard et al. . | |
| 5,755,114 | 5/1998 | Foglietta . | |

*Primary Examiner*—Ronald Capossela

*Attorney, Agent, or Firm*—Frost & Jacobs LLP

[57] ABSTRACT

A method and apparatus for an engine driven system having the capability of liquefying 100% of the natural gas entering the system. The apparatus is connected to a source of clean natural gas, and comprises an engine or prime mover, a compressor and an expander, all drivingly connected, at least one cooler, at least one heat exchanger, a restrictor, a liquid natural gas collector and connecting conduits. The clean natural gas is provided to the inlet of the compressor and is compressed. The compressed natural gas is passed through the at least one cooler to remove heat of compression. The natural gas is split into two flow portions. The first flow portion is cooled in the at least one heat exchanger and is passed through the restrictor into the collector. The temperature and pressure of the first flow portion are such that a substantial portion flashes to liquid natural gas. The collector is operatively connected to the compressor to cause any saturated vapor from the collector to recirculate back to the compressor. The second flow portion enters the expander wherein it is lowered both in temperature and pressure and the work of expansion is extracted. The second flow portion from the expander is used in the at least one heat exchanger as the heat exchange cooling medium. Thereafter, the second flow portion is recirculated back to the compressor. In a second embodiment of the system, a second heat exchanger is added. In a third embodiment of the system, the vent return from the collector is modified to permit the vent return gas to be burned in the engine or disposed of through the engine exhaust to prevent those gases having a lower boiling point temperature than methane from poisoning the system. A fourth embodiment is a combination of embodiments two and three.

20 Claims, 4 Drawing Sheets

LIQUID NATURAL GAS SYSTEM WITH AN INTEGRATED ENGINE, COMPRESSOR AND EXPANDER ASSEMBLY

REFERENCE TO RELATED APPLICATION

The present invention is related to co-pending application Ser. No. 09/157,026, filed Sep. 18, 1998, in the name of Richard P. Johnston and entitled METHOD AND APPARATUS FOR THE PARTIAL CONVERSION OF NATURAL GAS TO LIQUID NATURAL GAS; and co-pending application Ser. No. 09/157,149, filed Sep. 18, 1998, in the name of Richard P. Johnston and entitled A SIMPLE METHOD AND APPARATUS FOR THE PARTIAL CONVERSION OF NATURAL GAS TO LIQUID NATURAL GAS, the disclosure of each of which is incorporated herein by reference.

TECHNICAL FIELD

A method and an apparatus for an engine driven system producing liquid natural gas, and more particularly to such a system capable of liquefying substantially 100% of the natural gas entering the system.

BACKGROUND ART

Prior art workers have devised numerous systems for liquefying substantially 100% of liquid natural gas fed into the systems. While the prior art systems work well, they are generally characterized by high expense and complexity. The present invention provides both a method and an apparatus for a greatly simplified system for liquefying substantially 100% of natural gas caused to enter the system.

In its simplest form the system comprises a source of natural gas. In addition, an engine in the form of any appropriate prime mover, a compressor and an expander are provided. These last mentioned elements are drivingly connected, as will be evident hereinafter. In addition, the system comprises at least one cooler, at least one heat exchanger, a restrictor and a liquid natural gas collector having a vent return back to the compressor. Pressurized natural gas, from an appropriate source, is fed to the inlet of the compressor. The compressed natural gas exits the compressor and passes through at least one cooler to remove the heat of compression. Thereafter, the compressed and cooled gas is split into first and second flow portions. The first flow portion passes through at least one heat exchanger so as to lower its temperature. Thereafter, it passes through the restrictor into the liquid natural gas collector. The pressure of the compressed natural gas and the performance levels of the apparatus components are such that a substantial portion of the first flow portion flashes to liquid natural gas in the collector. As will be set forth hereinafter, there will generally be some saturated vapor which will be driven out of the collector. For this reason, the collector is provided with an exhaust which is operatively connected to the compressor inlet.

The second flow portion of the compressed and cooled gas is directed to an expander wherein its pressure and its temperature are both reduced by extracting work from the expander. The second flow portion is conducted from the expander to the at least one heat exchanger wherein it serves as a cooling medium therefor. The second flow portion from the at least one heat exchanger is mixed with any saturated vapor from the collector and recirculated to the compressor inlet.

The embodiment just described can be modified to remove gases having a lower boiling point temperature than methane from the feed stock stream. This is often important since the accumulation of these lower boiling point gases such as nitrogen, helium, hydrogen, and the like, in the recirculating stream will eventually "poison" the system so that it cannot handle any new natural gas inlet flow, but can only recirculate the stream of lower boiling point gases.

Removal of the lower boiling point gases is accomplished by altering the vent return path to permit the vent return gas to be burned in an internal combustion type engine, or to be disposed of through the engine exhaust. In the embodiment having this modification, it is preferred that a gas-fueled engine be used. Such an engine can be partially or wholly fueled by the return vent gas.

There are other ways to remove these lower boiling point gases, as will be set forth hereinafter.

Both embodiments just described can be modified to have a second heat exchanger, as will be apparent hereinafter.

DISCLOSURE OF THE INVENTION

According to the invention there is provided both a method and apparatus for an engine driven system having the capability of liquefying substantially 100% of the natural gas entering the system. The apparatus is connected to a source of natural gas and comprises a prime mover, a compressor and an expander. The prime mover, the compressor and the expander being drivingly connected. The apparatus further comprises at least one cooler, at least one heat exchanger, a restrictor, a liquid natural gas collector, and connecting conduits.

If the natural gas is not free of impurities which may clog the apparatus or hinder the formation of liquid natural gas, then one or more purifiers would be required, as explained hereinafter. The natural gas is provided to the inlet of the compressor and is compressed to appropriately raise the pressure of the natural gas. The compressed natural gas is passed through at least one cooler to remove the heat of compression. Immediately thereafter, the natural gas is split into two flow portions. The first flow portion is cooled in at least one heat exchanger and is passed through the restrictor into the collector. The efficiency of the equipment, and the temperature and pressure of the first flow portion are such that a substantial portion of the first flow portion flashes to liquid natural gas in the collector. The collector is operatively connected to the compressor intake to cause the vent remainder of the first flow portion to be recirculated to the compressor.

The second flow portion enters the expander and is lowered in temperature and pressure therein by extracting work from the expander. The second flow portion is conducted from the expander and is used in the at least one heat exchanger as the heat exchange medium therefor. From the at least one heat exchanger, the second flow portion is recirculated to the compressor inlet.

A second embodiment of the present invention is similar to the first, but utilizes a second heat exchanger.

In a recirculating gas process such as is taught herein, there is a possibility that lower boiling point temperature gases (nitrogen, helium, hydrogen or the like) could enter with the feed stock stream as impurities. Since the system continuously liquefies the methane and higher boiling point temperature gases, the fraction of feed stock stream consisting of these lower boiling point temperature gases would gradually increase, the lower boiling point temperature gases continuing to recirculate through the system. It is currently very difficult to remove these lower boiling point temperature gases using existing technology methods.

When the high pressure cold first flow portion passes through the restrictor, a significant portion of the higher boiling point temperature gases such as methane, ethane, and the like, will liquefy leaving a much higher portion of the vent stream consisting of non-coalescing lower boiling point temperature gases. If, however, this lower boiling point gas enriched stream is stripped off the recirculating feed stock stream through the vent gas and can be burned in or disposed of through the exhaust of a suitable gas-burning engine (serving as the prime mover), the lower boiling point temperature gas fraction in the recirculating feed stock will stay at some low equilibrium level such that it will not seriously impair the liquid natural gas production rate as a portion of the feed stock flow through the restrictor. A third embodiment of the present invention illustrates such an apparatus and a method of lower boiling point temperature gas removal. There are other ways in which lower boiling point temperature gases can be removed, as will be discussed hereinafter. Finally, a fourth embodiment is similar to the third embodiment, but utilizes two heat exchangers.

DETAILED DESCRIPTION OF THE INVENTION

Figure 1:
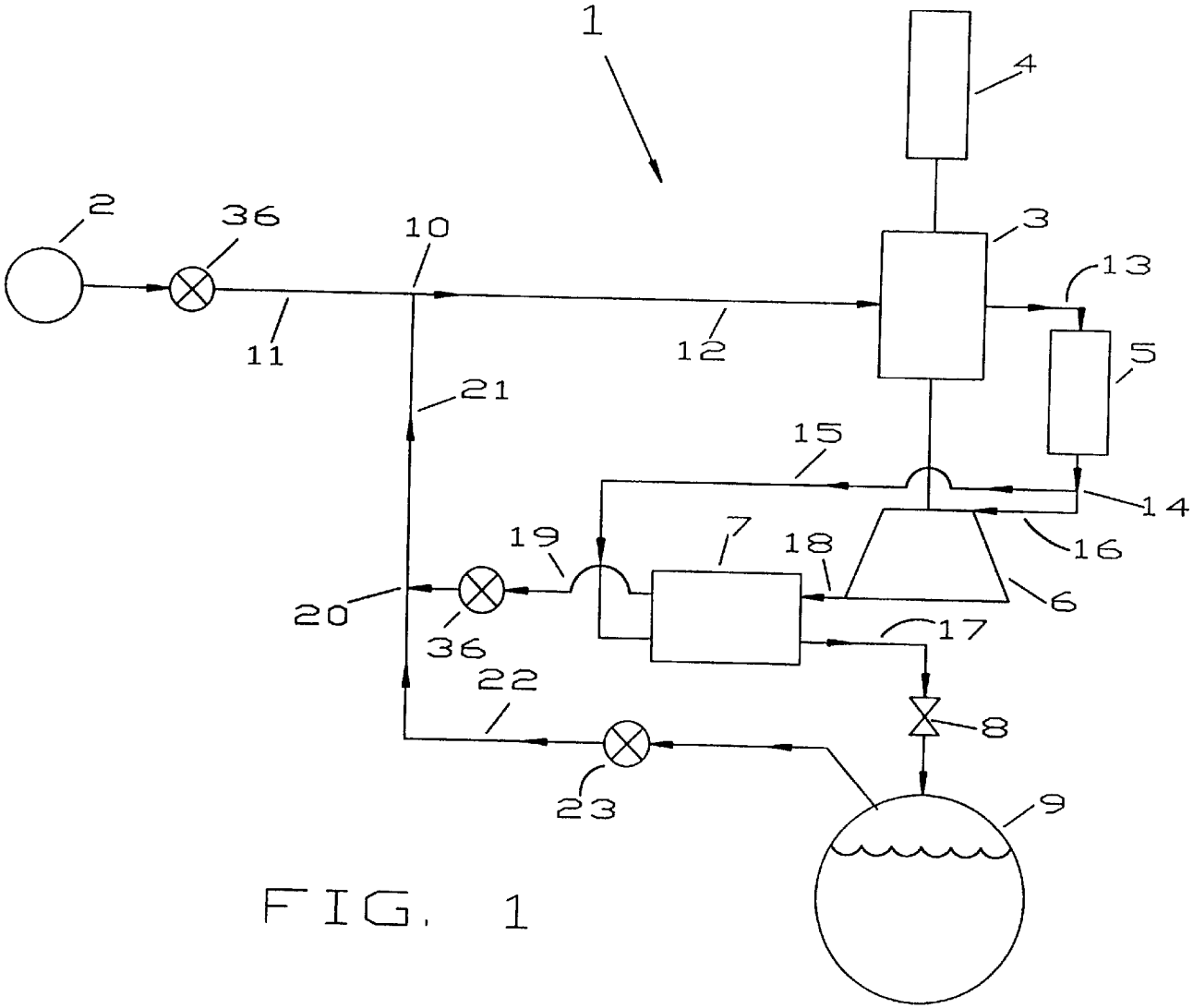
FIG. 1 is a simplified schematic representation of a first embodiment of the system of the present invention.

Reference is first made to FIG. 1 illustrating in diagrammatic form the simplest embodiment of the present invention. The overall system is generally indicated at 1. The system is connected to a source 2 of natural gas, and comprises a compressor 3, an engine or other appropriate prime mover 4, at least one cooler 5, an expander 6, at least one heat exchanger 7, a restrictor 8 and a liquid natural gas collector 9.

The source 2 of the natural gas can be any appropriate source which will provide relatively cool and clean natural gas. The gas should be substantially free of constituents which will interfere with the production of liquid natural gas. If not, the gas must be cleansed, as will be discussed hereinafter. The natural gas source 2 is connected to a point 10 by a conduit 11. The purpose of point 10 will be apparent hereinafter. It will be noted that point 10 is connected to compressor 3 by a conduit 12. The compressor 3 can be of any appropriate type, having at least one stage of compression. The natural gas is compressed in compressor 3 to a sufficiently high pressure for the production of liquid natural gas. The compressed natural gas is conducted by conduit 13 to the at least one cooler 5 to remove the heat of compression. The cooler employs a provided source of coolant (not shown).

The cooled, high pressure gas is then split into first and second flow portions at point 14. The first flow portion passes through conduit 15 and the second flow portion passes through conduit 16.

The first flow portion is conveyed by conduit 15 to the at least one heat exchanger 7 wherein it is cooled to a temperature level appropriate for conversion of a substantial portion of said first flow portion to liquid natural gas. The at least one heat exchanger may be of any appropriate type and the type used is not a limitation of the present invention. Excellent results have been achieved, for example, with a cross-counter flow type heat exchanger.

The cooled first flow portion from the heat exchanger is conducted by conduit 17 to a liquid natural gas collector 9. The conduit 17 contains a restrictor 8. The restrictor 8 may take any appropriate form. As a non-limiting example, the restrictor 8 may constitute a throttle valve. As will be developed hereinafter, it is preferable that the restrictor be adjustable. The collector 9 also can be of any appropriate type. A liquid natural gas tank would be a typical type of collector for this purpose. As will be pointed out hereinafter, the efficiencies of the apparatus and the temperatures and pressures of system 1 are such that a substantial portion of the first flow portion will flash to liquid natural gas.

The second flow portion is conducted from point 14 by conduit 16 to expander 6. The expander may be of any appropriate type capable of sufficiently lowering the pressure and temperature of the second flow portion by extracting work from the expander. A positive displacement piston expander, a turbo expander, and a radial vane expander, etc., are non-limiting examples of expanders appropriate for system 1. The second flow portion, reduced in temperature and pressure, is conducted by conduit 18 from expander 6 to the at least one heat exchanger 7 wherein it serves as a cooling medium. The second flow portion exits the at least one heat exchanger via conduit 19 and passes through point 20 from which it is conducted in conduit 21 to point 10. At point 10, the second flow portion joins the incoming natural gas from source 2 and passes through conduit 12 to compressor 3. Thus, the second flow portion is recirculated from the at least one heat exchanger 7 to the compressor 3.

It will be noted that compressor 3, engine 4 and expander 6 are drivingly connected. The output work of expander 6 is absorbed by compressor 3, thus lessening the power required from engine 4. The engine 4, itself, can be of any appropriate type including an internal combustion engine, powered by any fuel, or it can constitute an electric motor or a hydraulic motor.

Collector 9 is provided with a vent return line 22 which leads to point 20. From point 20, the line 22 is connected to compressor 3 by lines 21 and 12 in the same manner as is the second flow portion from the one at least heat exchanger 7 via line 19.

After a substantial portion of the first flow portion flashes into liquid natural gas in collector 9, some cold natural gas saturated vapor will need to escape from the collector. This can be accommodated by vent return line 22. The escaping natural gas saturated vapor will be recirculated to compressor 3 by means of conduits 21 and 12. In most general cases, the pressure of the collector 9 will be approximately the same as the pressure from the source 2 and the inlet of compressor 3. If a higher pressure level is required in the collector, a restrictor in the form of an adjustable pressure regulator 23 would be located in the return vent line 22 to maintain the desired pressure differential. If, it is desired that the pressure level in collector 9 be lower than the source pressure, at least one gas pump (not shown) would be located in the vent return line 22 to raise the pressure of the vent gas to approximate that of the natural gas from the source 2 and at the inlet of compressor 3.

Figure 2:
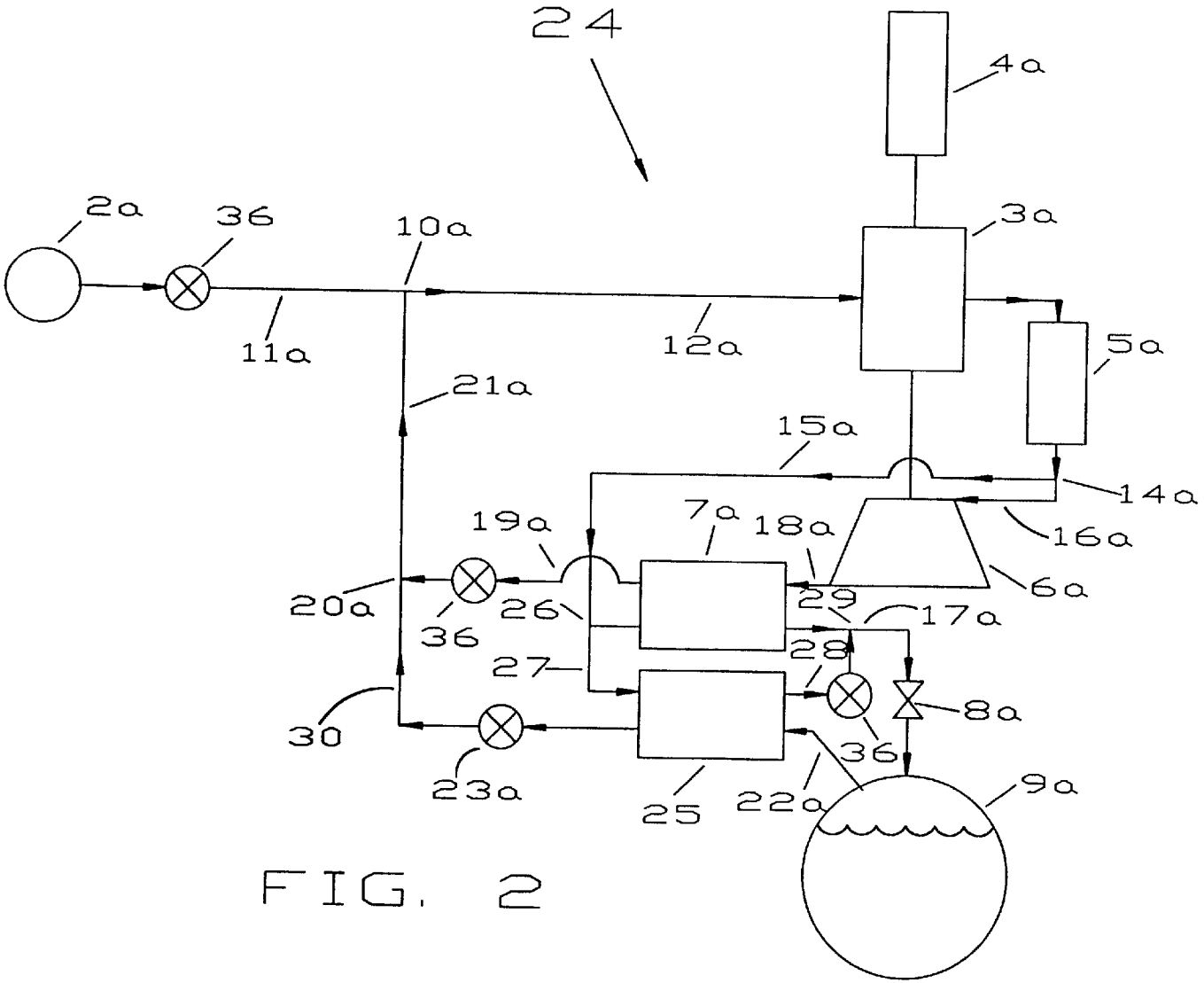
FIG. 2 is a simplified schematic representation of a second embodiment of the system of the present invention.

As is indicated above, it would be within the scope of the present invention to provide system 1 of FIG. 1 with a second heat exchanger to take advantage of the cold vent remainder from the liquid natural gas collector. Such a modification of the system of FIG. 1 is illustrated in FIG. 2 and is generally indicated at 24. A comparison of FIGS. 1 and 2 clearly shows that the difference between system 1 and system 24 lies in the addition of a second heat exchanger. For this reason, the apparatus elements of FIG. 2, which have an identical counterpart in FIG. 1, have been given the same index numerals as in FIG. 1, followed by "a".

In FIG. 2 the second heat exchanger is illustrated at 25. It will be noted that at point 26 on line 15*a* there is an extension 27 leading to the second heat exchanger 25. Thus, the first flow portion from source 2*a*, compressor 3*a*, cooler 5*a* and point 14*a* passes through conduit 15*a* to point 26. Here, the first portion is split into two parts, one entering first heat exchanger 7*a* and the other entering second heat exchanger 25 via conduit 27. The first part of the first portion exits the first heat exchanger 7*a* via conduit 17*a* to restrictor 8*a*. The second part of the first flow portion exits the second heat exchanger 25 via conduit 28 and joins the first part at point 29 in conduit 17*a*. Thereafter, the rejoined first and second parts of the first flow portion pass through restrictor 8*a* and into liquid natural gas collector 9*a*. The vent remainder from collector 9*a* passes through conduit 22*a* through the second heat exchanger to serve as a coolant therefor. The vent remainder is thereafter conducted by conduit 30 through adjustable pressure regulator 23*a* to point 20*a* where it joins the second flow portion from first heat exchanger 7*a* via conduit 19*a*. The combined vent remainder and second flow portion are conducted via conduit 21*a* to point 10*a*. At point 10*a* they are joined by flow from source 2*a* via conduit 11*a* and are conducted by conduit 12*a* to compressor 3*a*.

As indicated above, depending upon the make up of the natural gas from the source, it may be desirable to provide a system which enables the removal of lighter gases (lower boiling point temperatures than methane) from the feed stock stream. This is important to the operation of the system since the accumulation of these lower boiling point temperature gases such as nitrogen, helium, hydrogen, etc., in the recirculating stream will eventually "poison" the system so that it cannot handle any new natural gas inlet flow from the source, but can only recirculate the lower boiling point temperature gas stream.

In a recirculating gas process such as system 1 of FIG. 1, there is the possibility that the lower boiling point temperature gases can enter with the feed stock as impurities. Since system 1 of FIG. 1 would continuously liquefy the methane and higher boiling point gases, the fraction of the feed stock stream consisting of these lower boiling point temperature gas impurities would gradually increase, since the lower boiling point temperature gases would continue to recirculate through the system without dropping out or being condensed.

Figure 3:
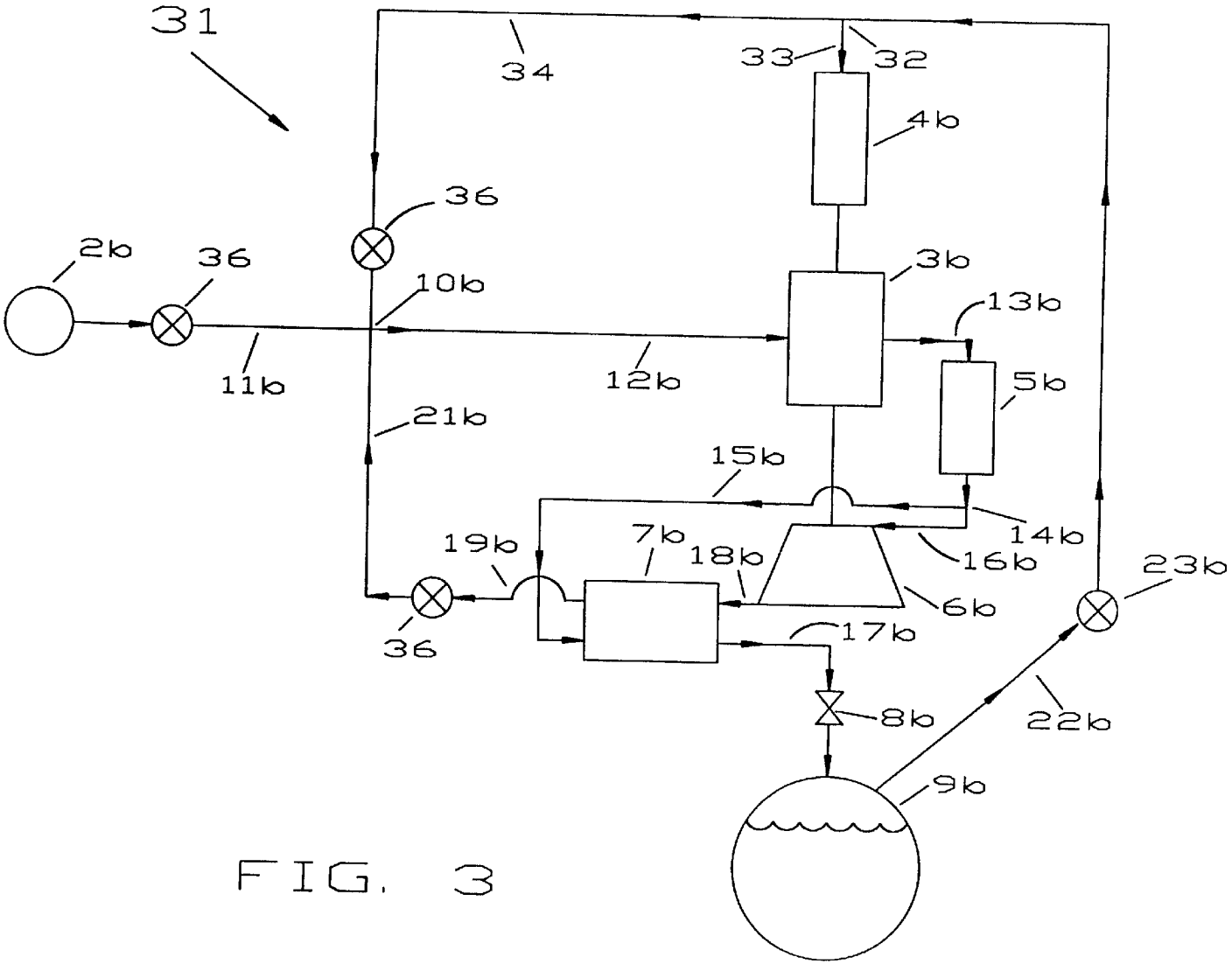
FIG. 3 is a simplified schematic representation of a third embodiment of the system of the present invention.

Reference is now made to FIG. 3, which illustrates a modified embodiment of system 1 of FIG. 1. In FIG. 3, the system shown is generally indicated at 31. A comparison of FIGS. 1 and 3 clearly shows that the difference between system 1 and system 31 lies in the modification of the vent return line. For this reason, the apparatus elements of FIG. 3, which have identical counter-parts in FIG. 1, have been given the same index numerals as in FIG. 1, followed by "b".

In the system 31 of FIG. 3, the collector 9b is provided with a vent return line 22*b*, which extends to point 32. The lower boiling point temperature gases escape collector 9*b* through vent return line 22*b* and are conducted to engine 4*b* via conduit 33. Thus, the lower boiling point temperature gases are burned in the engine 4*b* or disposed of through the engine exhaust. In a preferred embodiment, the engine 4*b* is gas-fueled so that engine 4*b* could be partially or wholly fueled by the return vent gas. Point 32 is also connected to point 10*b* by conduit 34 so that excess vent gas can be recirculated via lines 34 and 12*b* to the compressor 3*b* alternatively, if there is insufficient vent gas to operate engine 4*b*, gas from source 2*b* can be conducted to engine 4*b* by conduits 34 and 33.

With the above noted exception of the vent return line alteration, the embodiment of FIG. 3 otherwise operates in an identical manner to that described with respect to the embodiment of FIG. 1. It will be understood that the vent return line 22*b* preferably contains a pressure regulator 23*b* similar to pressure-regulator 23 and serving the same purposes. Again, the pressure regulator 23*b* is preferably of the adjustable type.

It is within the scope of the present invention to provide a system such as system 24 of FIG. 2 with a vent return of the type shown in system 31 of FIG. 3. Such a combined system is illustrated at 35 in FIG. 4. Those parts of system 35 which have identical counterparts in systems 24 and 31 are given the same index numerals followed by "c". It will be apparent from FIG. 4 that the vent flow passes through conduit 22*c*, heat exchanger 25*c*, and adjustable regulator 23*c* to point 32*c* through conduit 30*c*. At this point, the lower boiling point temperature gases of the vent flow are conducted to engine 4*c* via conduit 33*c*. Thus, the lower boiling point temperature gases are burned in engine 4*c* or disposed of through the engine exhaust. Once again, it is preferred that engine 4*c* is a gas-fueled engine so that engine 4*c* could be partially or wholly fueled by the return vent gas. As is the case in FIG. 3, the point 32*c* is also connected to point 10*c* by conduit 34*c* so that excess vent gas can be recirculated via lines 34*c* and 12*c* to the inlet of compressor 3*c*. Alternatively, if there is insufficient vent gas to operate engine 4*c*, gas from source 1*c* can be conducted to engine 4*c* by conduits 34*c* and 33*c*.

Figure 4:
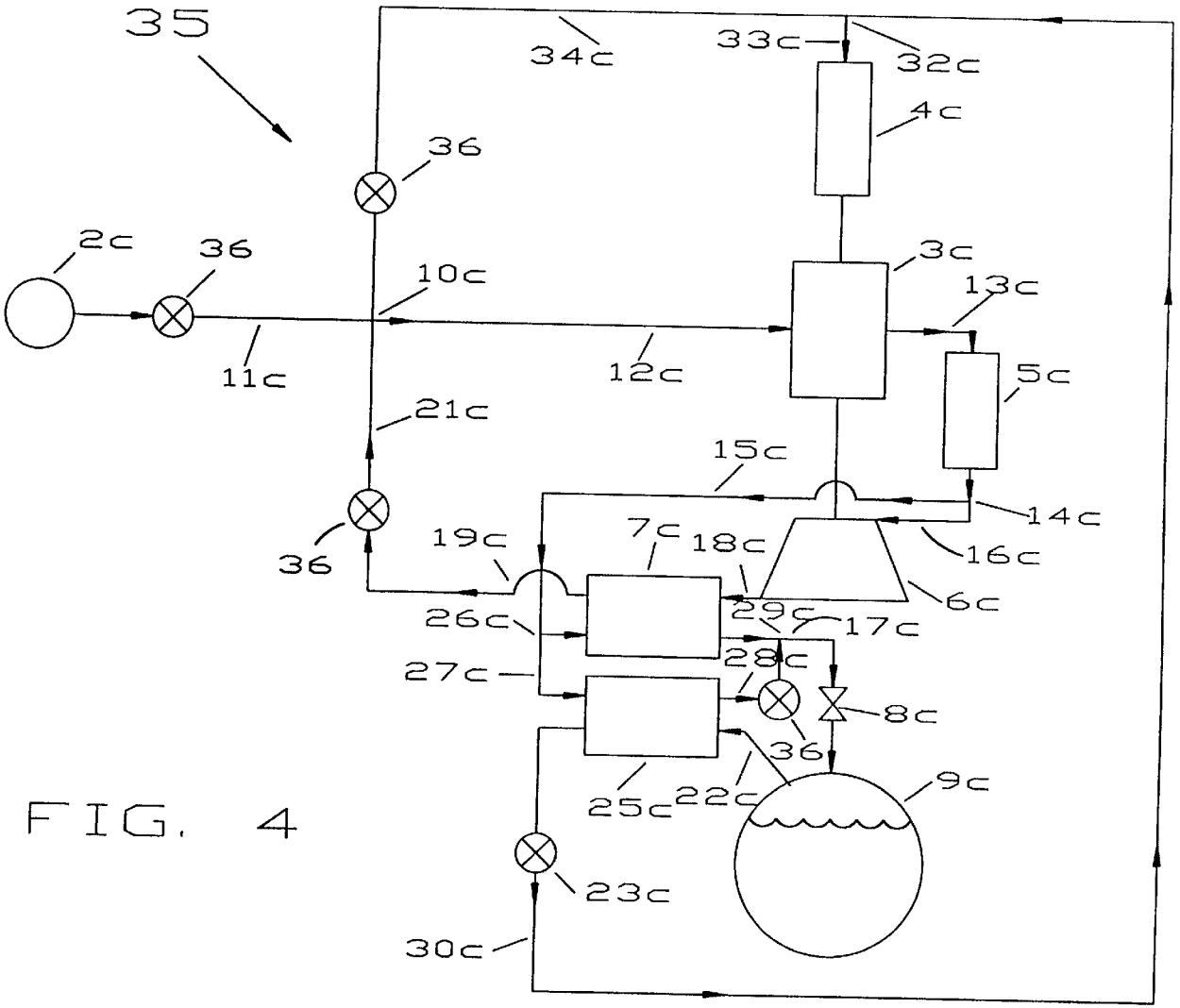
FIG. 4 is a simplified schematic representation of a fourth embodiment of the present invention.

In an exemplary comparison of embodiment 31 of FIG. 3 and embodiment 35 of FIG. 4, identical compressor outlet pressure and temperature levels, heat exchanger effectiveness levels, and expander adiabatic efficiencies were applied to both systems. In both embodiments 31 and 35 (as shown in FIGS. 3 and 4, respectively), the gas source was assumed to have a pressure of 100 psia at a temperature of 70° F. (530° R). The outlet of the compressor cooler was assumed to have a pressure of 1800 psia and a temperature of 40° F. (500° R). In both embodiments, the heat exchange effectiveness levels were considered to be 0.90 and the expander adiabatic efficiency levels were considered to be 80%.

In view of the above Figures, it was found that for embodiment 35 of FIG. 4, with the economizing cooling heat exchanger 25*c* in the vent return stream line 22*c* together with a small part of the high pressure LNG feedstock stream diverted to it, 5.6% more feedstock source stream was converted to LNG per recirculation pass. In terms of a recirculation rate through the compressor/throttle system and return, embodiment 31 of FIG. 3 recirculated the gas stream 3.57 times as compared to a recirculation rate for embodiment 35 of FIG. 4 of 3.38 times for a 100% conversion. In other words, the embodiment of FIG. 3 required 5.6% more energy than did the embodiment 35 of FIG. 4 for the same production rate. These results clearly show that the use of a second heat exchanger does give better results than the use of a single heat exchanger. However, the magnitude of this difference between the two embodiments is such that to add a second heat exchanger might well be considered an economic decision, depending upon the circumstances.

In the embodiments being compared with the assumed values stated above, the following splits (TABLE I below)

were found to optimize the heat exchange cooling process for both embodiment 31 and embodiment 35. Both embodiments produced the identical quantity of LNG (100) with the following parameters:

TABLE I

| | Embodiment 31 | Embodiment 35 |
|---|---|---|
| Source Flow | 115.8 | 115.0 |
| Compressor Flow | 357.0 | 337.9 |
| Expander Flow | 238.8 | 220.3 |
| Main Heat Exchanger Flow (feedstock) | 118.2 | 109.2 |
| Vent Heat Exchanger Flow (feedstock) | N/A | 8.4 |
| Restrictor Flow (feedstock) | 118.2 | 117.6 |
| Vent Return Flow | 18.2 | 17.6 |
| Engine Fuel Flow | 15.8 | 15.0 |
| Vent (less fuel) Return | 2.4 | 2.6 |

The main system flow splits as a percentage of total compressor flow are set forth below in TABLE II.

TABLE II

| | Embodiment 31 | Embodiment 35 |
|---|---|---|
| Expander flow | 66.9 | 65.2 |
| Main Heat Exchanger flow | 33.1 | 32.2 |
| Vent Heat Exchanger flow | N/A | 2.5 |

It will be understood that a comparison of embodiments 1 and 24 would yield numbers substantially the same as those set forth in TABLES I and II above. This is true because the lower boiling point temperature gas separation feature of embodiments 31 and 35 does not substantially affect performance levels other than the purging of lower boiling point temperature gas impurities, if present in the feedstock stream. If anything, the comparison of embodiments 1 and 24 might show very slightly improved results over those of the comparison of embodiments 31 and 35, because embodiments 1 and 24 start out with clean gas from the source, and therefore no energy is expended in removing the lower boiling point gases.

The present invention provides a simple way of removing the lower boiling point temperature gases. Other methods of removing the lower boiling point temperature gases are known and could be applied to the embodiments of FIGS. 3 and 4. These methods are generally more complex and more expensive to use. For example, lower boiling point temperature gases can be preferentially removed from the return vent stream through the use of selective permeable membranes or through the use of a chemical bath or structure that has an affinity for the lower boiling gases of interest. Heretofore, prior art workers have eliminated nitrogen by liquifying the nitrogen and separating it from the system.

The maintenance of proper flows and pressure levels throughout the embodiments of the process system of the present invention depended primarily on the existence of stable inlet and exhaust pressures and flows. This stability requirement can be alleviated to some extent by the judicious placement of inlet exhaust and expander exhaust pressure regulators. As has already been mentioned above, pressure regulators 23, 23*a*, 23*b*, and 23*c* are preferably located in the vent return lines of systems 1, 24, 31 and 35, and are preferably adjustable. Additional adjustable pressure regulators could be added in systems 1, 24, 31, and 35 as indicated at 36.

From the above, it will be apparent that the added regulators are desirable to modify flow and pressure throughout the systems to maintain design levels of pressure and flow. This must be done for efficient operation in the face of variations in upstream supply and downstream exhaust conditions, along with inevitable change in system component performance due to wear, blockage, deposit accumulations, and the like.

When purification of the gas is required, this can be accomplished in a number of ways. In FIG. 1, for example, purifier equipment could be located in conduit 11 or conduit 12 to thoroughly clean the source flow before it enters compressor 3. A gas-oil separator should also be located in conduit 13 unless compressor 3 is an oil-less compressor. Another approach would be to locate purifier equipment in line 11 or 12 to partially purify the source flow to remove any impurities which might clog the apparatus. A second and more thorough purifier treatment can be applied to the first flow portion to remove those impurities which would interfere with the formation of liquid natural gas. Alternatively, it would be possible to apply a thorough purifier treatment to the first flow portion from which the liquid natural gas is derived, and to subject the second flow portion to a lesser purifying treatment, primarily removing those impurities which might clog the apparatus. Anyone of the above approaches can be applied to the embodiments of FIGS. 2, 3 and 4.

Although the embodiments of the present invention have been described in terms of natural gas, the invention is applicable to the liquification of other appropriate gases.

Modifications may be made in the invention without departing from the spirit of it.

What is claimed is:

1. A method of converting 100% of natural gas from a source thereof to liquid natural gas, said method comprising the steps of providing a prime mover, a compressor, an expander, at least one cooler, at least one heat exchanger, a restrictor, and a liquid natural gas collector, conducting said gas from said source to said compressor, compressing said source gas, conducting said compressed source gas through at least one cooler to remove the heat of compression therefrom, splitting said source gas from said at least one cooler into first and second flow portions, conducting said first flow portion through said at least one heat exchanger, said restrictor and into said collector, the temperature and pressure of said first flow portion being such that a substantial portion of said first flow portion flashes to liquid natural gas with a saturated vapor vent remainder, conducting said second flow portion to said expander and lowering the temperature and pressure thereof, conducting said second flow portion through said at least one heat exchanger as a heat exchange cooling medium, recirculating said second flow portion back to said compressor, causing said prime mover, said compressor and said expander to be drivingly connected, whereby output work of said expander is absorbed by said compressor lessening the power required from said engine.

2. The method claimed in claim 1 wherein said at least one heat exchanger comprises a first heat exchanger, and including the steps of providing a second heat exchanger, splitting said first flow portion into first and second flow parts, conducting said first flow part through said first heat exchanger and said second flow part through said second heat exchanger, thereafter reuniting said first and second flow parts, and directing said reunited first flow portion through said restrictor and into said collector, and conducting said vent remainder through said second heat exchanger as a cooling medium therefor.

3. The method claimed in claim 2 wherein said source gas as it enters said compressor is free of gases having a boiling point temperature below that of methane, and including the step of recirculating said vent remainder from said second heat exchanger to said compressor.

4. The method claimed in claim 2 wherein said source gas includes gases having a lower boiling point temperature than methane and which will not flash to liquid in said collector, and including the steps of providing said prime mover in the form of an internal combustion engine, directing said vent gas containing said lower boiling point temperature gases from said collector to said engine for disposal through said engine exhaust.

5. The method claimed in claim 2 wherein said source gas contains gases having a lower boiling point temperature than methane and which will not flash to liquid in said collector, and including the steps of providing said prime mover in the form of a gas-fueled internal combustion engine, directing said vent gas to said engine to be burned as fuel therefor, adding source gas as engine fuel when there is insufficient vent gas for the purpose, and recirculating vent gas to said compressor inlet when there is an excess thereof.

6. The method claimed in claim 2 wherein said source gas includes gases having a lower boiling point than methane and which will not flash to liquid in said collector, and including the steps of removing said lower boiling point temperature gases from the vent remainder by conventional chemical or physical means and recirculating said vent remainder to said compressor inlet.

7. The method claimed in claim 1 wherein said source gas as it enters said compressor is free of gases having a boiling point temperature below that of methane, and including the step of recirculating said vent remainder from said collector back to said compressor.

8. The method claimed in claim 1 wherein said source gas includes gases having a lower boiling point temperature than methane and which will not flash to liquid in said collector, and including the steps of providing said prime mover in the form of an internal combustion engine, directing said vent gas containing said lower boiling point temperature gases from said collector to said engine for disposal through said engine exhaust.

9. The method claimed in claim 1 wherein said source gas contains gases having a lower boiling point than methane and which will not flash to liquid in said collector, and including the steps of providing said prime mover in the form of a gas-fueled internal combustion engine, directing said vent gas to said engine to be burned as fuel therefor, adding source gas as engine fuel when there is insufficient vent gas for the purpose, and recirculating vent gas to said compressor when there is an excess thereof.

10. The method claimed in claim 1 wherein said source gas includes gases having a lower boiling point than methane and which will not flash to liquid in said collector, and including the steps of removing said lower boiling point gases by conventional chemical or physical means from the vent remainder and then recirculating said vent remainder to said compressor.

11. A system for converting 100% of natural gas entering the system from a source thereof to liquid natural gas, said system comprising a prime mover, a compressor with an inlet and outlet, an expander, at least one cooler, at least one heat exchanger, a restrictor and a liquid natural gas collector, said gas source being connected through a junction point to said compressor inlet, said compressor outlet being connected to said at least one cooler, whereby said source gas is compressed and cooled to remove heat of compression, a first split point, said at least one cooler being connected to said first split point, where said compressed and cooled source gas is split into separate first and second flow portions, said first split point having a first outlet for said first flow portion connected to said at least one heat exchanger said at least one heat exchanger being connected to said restrictor and said restrictor being connected to said collector whereby said first flow portion of said source flow is cooled by said at least one heat exchanger and passes through said restrictor into said collector wherein a substantial portion of said first flow portion flashes to liquid natural gas with a saturated vapor vent remainder, said first split point having a second outlet for said second flow portion connected to said expander, said expander being connected to said at least one heat exchanger whereby said second flow portion is expanded and cooled and serves as a cooling medium for said at least one heat exchanger, said at least one heat exchanger being connected to said junction point whereby said second flow portion is recirculated from said at least one heat exchanger to said compressor, said prime mover, said compressor and said expander being drivingly connected whereby output work of said expander is absorbed by said compressor lessening the power requirement from said engine.

12. The system claimed in claim 11 wherein said at least one heat exchanger comprises a first heat exchanger, a second heat exchanger, said first outlet of said first split point for said first flow portion being connected to a second split point, said second split point having a first outlet connected to said first heat exchanger and a second outlet connected to said second heat exchanger whereby said first flow portion is split into first and second flow parts with said first flow part being cooled by said first heat exchanger and said second flow part being cooled by said second heat exchanger, said first and second heat exchangers having outlets for said first and second flow parts, said outlets of said first and second heat exchangers merge and are connected to said restrictor, whereby said cooled first and second flow parts are reunited and pass through said restrictor into said collector, said collector being connected to said second heat exchanger whereby said vent remainder serves as a cooling medium for said second heat exchanger.

13. The system claimed in claim 12 wherein said source gas entering said compressor is free of gases having a boiling point temperature below that of methane, said second heat exchanger being operatively connected to said junction point whereby said vent remainder is recirculated to said compressor.

14. The system claimed in claim 12 wherein said source gas contains gases having a lower boiling point temperature than methane and which will not flash to liquid in said collector, said prime mover comprising an internal combustion engine, said second heat exchanger being connected to said engine whereby said vent remainder containing said lower boiling point temperature gases flows to said engine and is disposed of through said engine exhaust, said engine being connected to said junction point whereby any excess vent remainder is recirculated to said compressor inlet.

15. The system claimed in claim 12 wherein said source gas contains gases having a lower boiling point temperature than methane and which will not flash to liquid in said collector, said prime mover comprising a gas-fueled internal combustion engine, said second heat exchanger being connected to said engine whereby said vent remainder containing said lower boiling point temperature gases flows to said engine to be burned as fuel therefor, said engine being connected to said junction point whereby source gas is added when there is insufficient vent remainder to fuel said engine and whereby vent remainder is recirculated to said compressor inlet when said vent remainder exceeds that amount required to fuel said engine.

16. The system claimed in claim 12 wherein said source gas contains gases having a lower boiling point temperature than methane and which will not flash to liquid in said collector, said collector being operatively connected to said junction point for recirculation of said vent remainder to said compressor inlet, one of a conventional physical means and a conventional chemical means to remove said lower boiling point gases being located in one of a position between said source and said junction point and a position between said second heat exchanger and said junction point, whereby to eliminate said lower boiling point gases.

17. The system claimed in claim 11 wherein said source gas entering said compressor is free of gases having a boiling point temperature below that of methane, said collector being operatively connected to said junction point whereby said vent remainder is recirculated to said compressor.

18. The system claimed in claim 11 wherein said source gas contains gases having a lower boiling point temperature than methane and which will not flash to liquid in said collector, said prime mover comprising an internal combustion engine, said collector being connected to said engine whereby said vent remainder containing said lower boiling point temperature gases flows to said engine and is disposed of through said engine exhaust, said engine being connected to said junction point whereby any excess vent remainder is recirculated to said compressor inlet.

19. The system claimed in claim 11 wherein said source gas contains gases having a lower boiling point temperature than methane and which will not flash to liquid in said collector, said prime mover comprising a gas-fueled internal combustion engine, said collector being connected to said engine whereby said vent remainder containing said lower boiling point temperature gases flows to said engine to be burned as fuel therefor, said engine being connected to said junction point whereby source gas is added when there is insufficient vent remainder to fuel said engine and whereby vent remainder is recirculated to said compressor inlet when said vent remainder exceeds that required to fuel said engine.

20. The system claimed in claim 11 wherein said source gas contains gases having a lower boiling point temperature than methane and which will not flash to liquid in said collector, said collector being operatively connected to said junction point for recirculation of said vent remainder to said compressor, one of a conventional physical means and a conventional chemical means to remove said lower boiling point temperature gases being located in one of a position between said source and said junction point and a position between said collector and said junction point, whereby to eliminate said lower boiling point temperature gases.

* * * * *